US006672242B2

(12) United States Patent
Webb

(10) Patent No.: US 6,672,242 B2
(45) Date of Patent: Jan. 6, 2004

(54) VESSEL

(76) Inventor: Anthony Keith Webb, The Bay House, Manor Park, Onchan, Douglas, Isle of Man (GB)

( * ) Notice: Subject to any disclaimer, the term of this patent is extended or adjusted under 35 U.S.C. 154(b) by 0 days.

(21) Appl. No.: 10/045,040

(22) Filed: Jan. 15, 2002

(65) Prior Publication Data

US 2003/0131780 A1 Jul. 17, 2003

(51) Int. Cl.[7] ..... B63B 23/00

(52) U.S. Cl. ..... 114/365; 114/366; 114/368; 114/373

(58) Field of Search ..... 114/365, 368, 114/369, 373, 366

(56) References Cited

U.S. PATENT DOCUMENTS

| | | | | |
|---|---|---|---|---|
| 1,842,572 A | | 1/1932 | Strauss | |
| 2,527,060 A | | 10/1950 | Dohn | |
| 4,365,579 A | * | 12/1982 | Perez, Jr. | 114/349 |
| 5,331,913 A | | 7/1994 | Tanaka et al. | 114/259 |

FOREIGN PATENT DOCUMENTS

| | | |
|---|---|---|
| DE | 299 11 729 | 11/1999 |
| GB | 2 108 054 A | 5/1983 |
| GB | 2 108 054 | 5/1983 |
| GB | 2 231 844 A | 11/1990 |

* cited by examiner

*Primary Examiner*—Stephen Avila
(74) *Attorney, Agent, or Firm*—Young & Thompson

(57) ABSTRACT

The vessel includes a lifeboat, a housing positioned at the side of the vessel and defining a recess in which the lifeboat is stowed, hatch access to the lifeboat from a boat deck of the vessel, and an element for deploying the lifeboat from its stowed position.

17 Claims, 2 Drawing Sheets

VESSEL

INTRODUCTION

This invention relates to a vessel and more particularly to a vessel having a lifeboat.

BACKGROUND OF THE INVENTION

The use of lifeboats on vessels, and particularly on passenger vessels, is well known. Lifeboats are typically mounted on the upper decks and are suspended from davit cranes via wire falls. Generally, the davits comprise a framework that permits sliding of the lifeboat outboard, and from there lowering can be effected by unwinding the falls.

Amongst the problems associated with this type of arrangement is the fact that, when in use, the lifeboat must initially be slid outboard before being lowered to deck level. This causes the lifeboat to be unstably suspended over open water, and thus fully exposed to the elements, while people attempt to cross to it.

Another drawback of this type of arrangement occurs due to the fact that a mustering or staging area for accessing the lifeboat is often located on an open or external deck. This can not only lead to difficulties in hearing instructions due to ambient noise, particularly on the windward side of a vessel, but also, if at night, often the only lighting will be sparsely situated deck lights. This combination of elements can often cause confusion, disorientation and danger.

The present invention seeks to overcome these problems.

SUMMARY OF THE INVENTION

According to the present invention, there is provided a vessel comprising a lifeboat, a housing positioned at the side of the vessel and defining a recess in which the lifeboat is stowed, hatch access to the lifeboat from a boat deck of the vessel, and means for deploying the lifeboat from its stowed position.

Preferable and/or optional features of the present invention are set out hereafter.

The invention will now be more particularly described, by way of example, with reference to the accompanying drawings.

DESCRIPTION OF THE PREFERRED EMBODIMENTS

Figure 1:
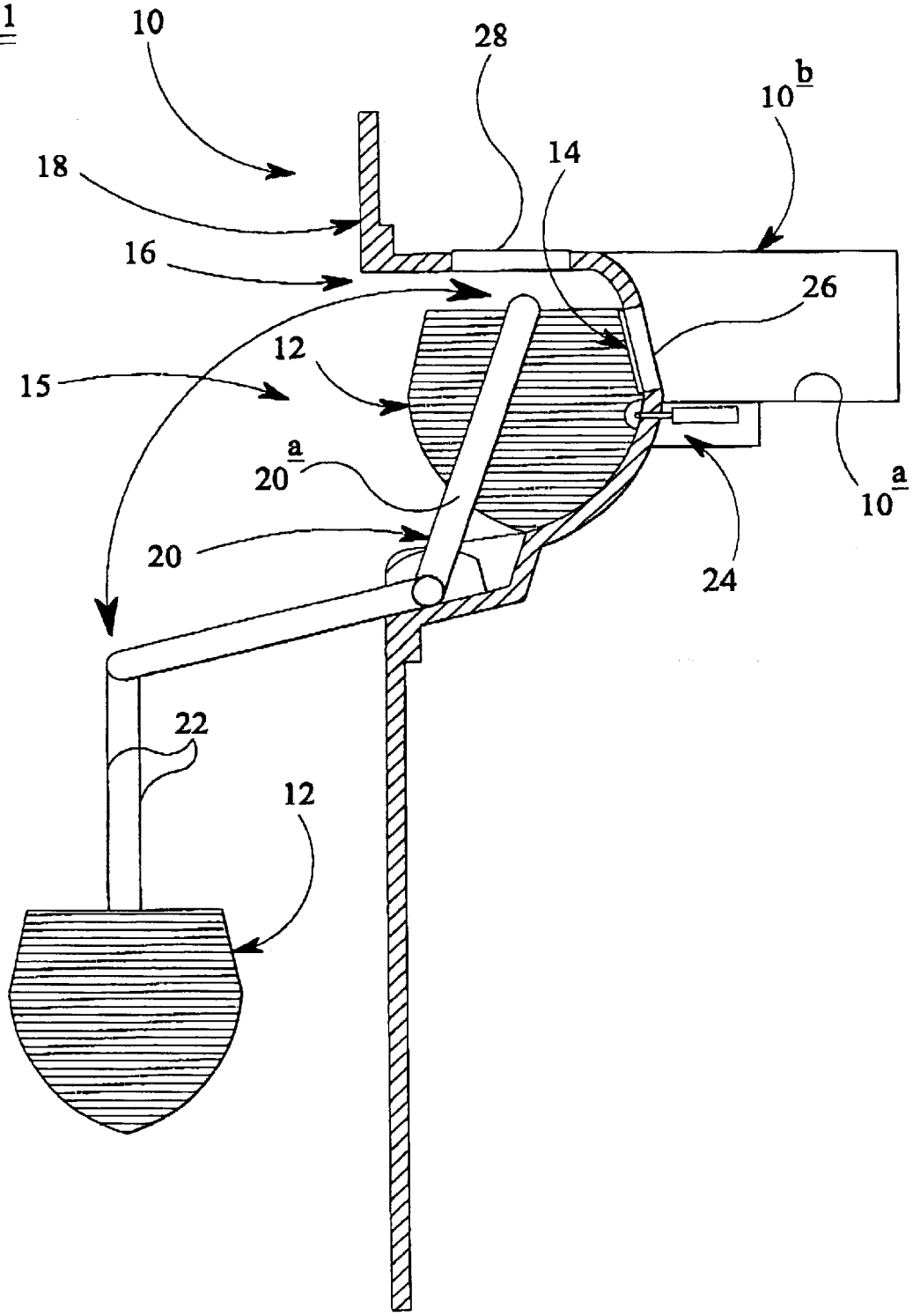
FIG. 1 is a partial transverse section through a hull of a vessel in accordance with the present invention.

Referring to the drawings, a vessel 10 shown therein comprises at least one lifeboat 12 having a watertight access hatch 14, a corresponding housing 15 formed in the side of the hull 18 of the vessel 10, and means for deploying the lifeboat 12.

The housing 15 defines a recess 16, which is formed to receive the lifeboat 12, and as such at least a part of the recess 16 and an adjacent side of the lifeboat 12 are of complementary or substantially complementary shape.

The lifeboat 12 is initially stowed in the recess 16 by the deployment means, which takes the form of a davit arm arrangement 20 and wire falls 22.

The davit arm arrangement 20 includes two davit arms 20*a* which are pivotably supported, typically on the bottom surface of the housing 15, about an upstanding position. Movement of the davit arm arrangement 20 is accomplished by one or more electric motors protectively housed away from the elements in the housing 15. Operation of the electric motors can be performed from the vessel 10 or lifeboat 12. Provision is also made for manual operation of the davit arm arrangement 20 from the vessel 10 in the event of power failure.

One end of each wire fall 22 is securely and releasably attached to the lifeboat 12, and the other end is attached to a winching drum (not shown), which is protectively housed away from the elements in the vessel 10. The wire falls 22, when being taken up and wound off the winching drum, are guided and supported by the davit arm arrangement 20. The winching drum is typically motorised, but may be manually operated in the event of power failure.

When first being stowed, the lifeboat 12 is hoisted on the falls 22 towards the davit arm arrangement 20, which is in a lowered position extending substantially perpendicularly from the side of the vessel 10. This is represented with phantom lines in the drawings. Once the lifeboat 12 reaches or substantially reaches the davit arms 20*a*, the davit arm arrangement 20 is operated to move the lifeboat 12 into the recess 16. Generally, the davit arms 20*a* will pivot over centre upon insertion, such that the centre of gravity of the lifeboat 12 moves to the inboard side of the davit arms 20*a*, thereby enabling the deployment means to aid in the retention of the lifeboat 12 in the recess 16.

A notch (not shown) may be formed in the bottom surface of the recess 16 to receive the keel (not shown) of the lifeboat 12. This not only ensures location of the lifeboat 12 during insertion into the recess 16, but also allows the lifeboat 12 to be more stably held in the recess 16.

The vessel 10 further comprises at least one latch mechanism 24 by which, once inserted into the recess 16, the lifeboat can be securely and releasably held therein.

The latch mechanism 24 is electrically operable from the vessel 10 and from the lifeboat 12. Provision is also made for the latch mechanism 24 being manually operable from the vessel 10 and from the lifeboat 12 in the eventuality of electrical power failure.

The vessel 10 also comprises hatch access to the lifeboat 12 from a boat deck of the vessel 10.

Typically, the recess 16 is located adjacent an internal boat deck 10*a*, which is formed with a watertight hatch 26 that, when opened, provides access to either the recess 16 or the lifeboat 12 if stowed therein. When the lifeboat 12 is in its stowed position, due to the complementary shapes of the lifeboat 12 and the recess 16, the access hatch 14 of the lifeboat 12 can be aligned and typically releasably mated with the watertight hatch 26 of the boat deck 10*a*.

Another boat deck 10*b*, typically residing above the boat deck 10*a*, may also be formed with a watertight hatch 28, which can act as a maintenance access to the lifeboat 12 and the housing 15.

In use, persons wishing to enter the lifeboat 12 will muster in the vicinity of the watertight hatch 26 on internal boat deck 10*a*. The watertight hatch 26 is opened providing access to the access hatch 14 of the lifeboat 12. This hatch 14 is opened and people can enter the lifeboat 12.

Once the lifeboat 12 is holding a sufficient number of occupants, the hatches 14 and 26 are separated if mated, the access hatch 14 is closed and sealed, and the latch mechanism(s) 24 is/are released. The davit arm arrangement 20 is then operated which, due to the initial position of the davit arms 20*a*, has the effect or initially raising the lifeboat 12 to allow the keel to clear the notch before moving the lifeboat 12 outboard to be suspended over open water. The winching drum is then operated to wind off the falls 22, and the lifeboat 12 is thereby lowered to the surface of the water. The falls 22 can then be manually released from the lifeboat 12, leaving the lifeboat 12 free to move away from the vessel 10.

Once the davit arms 20*a* are moved past top dead centre, such that the centre of gravity of the lifeboat 12 is on the outboard side of the davit arms 20*a*, further deployment may be gravity assisted.

In a second embodiment of the present invention, the davit arms 20*a* of the davit arm arrangement 20 are not pivoted over centre during stowing of the lifeboat 12 and are only pivoted to a position whereby the centre of gravity of the lifeboat 12 remains to the outboard side of the davit arms 20*a*. This allows manual activation of the davit arm arrangement 20 by, for example, operation of the latch mechanism (s) 24 from either the vessel 10 or lifeboat 12. Upon release, the davit arm arrangement 20 will lower due to gravity, thereby moving the lifeboat 12 from the recess 16 to a suspended outboard position. The winch drum may similarly be operable under gravity so that, once positioned outboard, the lifeboat 12 can be automatically lowered to the surface of the water.

In this case, a modified keel notch is utilised, which allows movement of the keel out of the notch during deployment.

To prevent free fall of the lifeboat if gravity assisted, the deployment means may comprise, for example, damping means, a torque limiting device and/or a braking device, typically being automatically activated during deployment of the lifeboat 12.

The location of the recess 16 in the side of the hull 18 of the vessel 10 advantageously allows access to a lifeboat 12 held therein via an internal boat deck. This is particularly desirable as the people wishing to use the lifeboat 12 will not only be protected from the elements, which will particularly aid sight and hearing, but will also have significantly better lighting, especially if use of the lifeboat 12 is required at night time, and more reassuring surroundings.

Since the lifeboat access is via an internal boat deck, the recess 16 in which the lifeboat 12 is held can be positioned at levels far closer to the surface of the water, and below the level of an external boat deck.

Also, since close alignment and mating hatch access is utilised between the watertight hatch 26 of the internal boat deck 10*a* and the hatch access 14 of the lifeboat 12, passengers are not exposed to the elements while trying to enter the lifeboat 12.

Further, people are not required to step out over open water in order to enter the lifeboat 12, because loading of the lifeboat 12 with passengers occurs while it is still in its stowed state. The lifeboat 12 is also held far more stably while people do enter due to the complementary shapes of the lifeboat 12 and the recess 16, due to the notch for the keel, and due to the latch mechanism(s) 24.

Lighting, typically powered from the vessel 10 via an umbilical supply, can be provided in the stowed lifeboat 12, which enables easier and safer access into the lifeboat 12, and also enables easier checking of passengers life jackets. The umbilical will be automatically disconnected during deployment.

The deployment means utilises a reduced number of parts in comparison to a conventional device. Since a significant proportion of the parts are housed under cover, corrosion from the elements is reduced, which should enable an increase in reliability and a decrease in maintenance costs.

Figure 2:
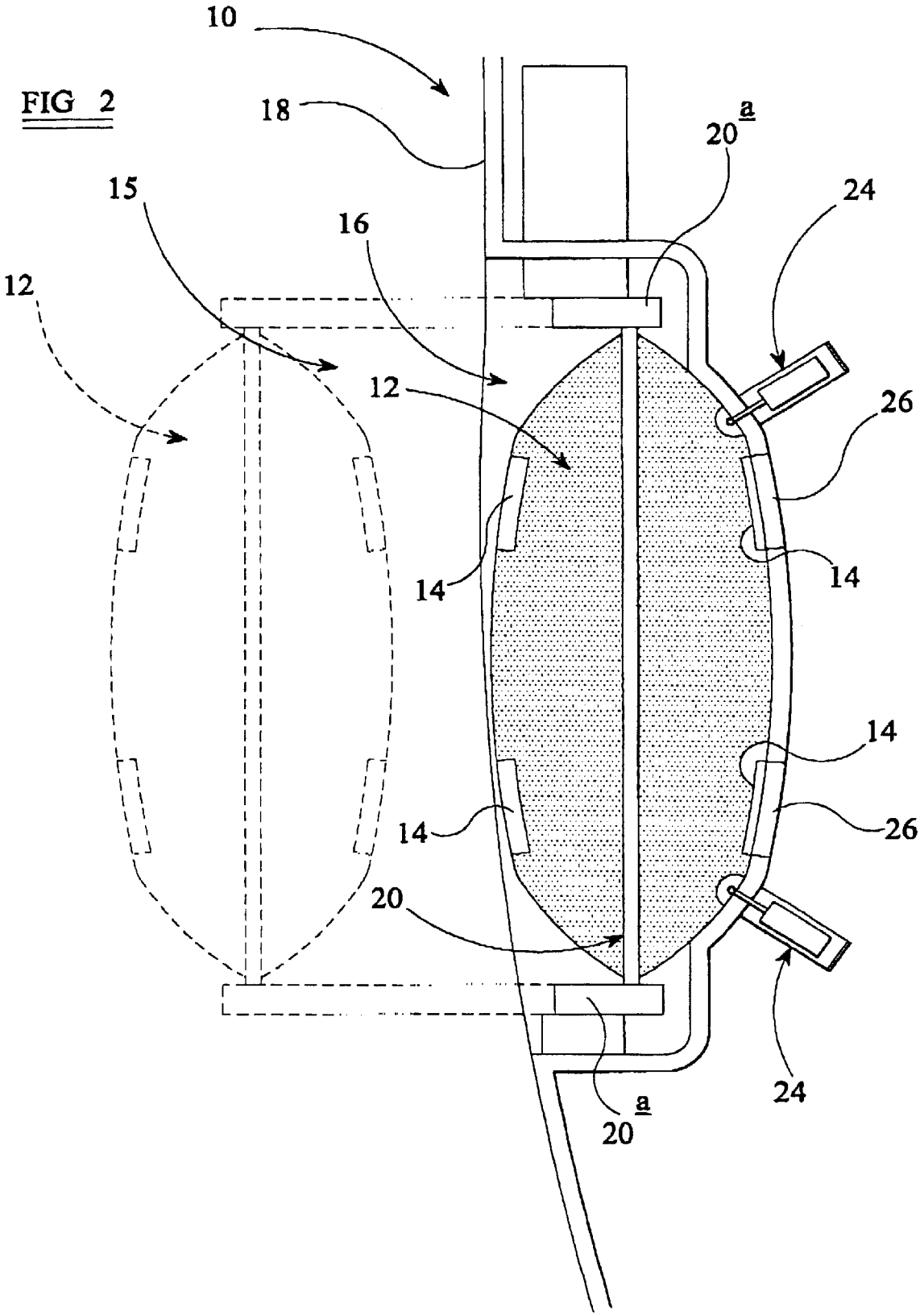
FIG. 2 is a top side plan view of a part of the vessel of FIG. 1.

It should be noted that more than one lifeboat 12 could be provided in one recess 16, and, as shown in FIG. 2, the lifeboats 12 may have more than one access hatch 14.

A strapping mechanism in addition to the latching mechanism(s) 24 may be utilised lo further secure the lifeboats 12 in the recesses 16.

The embodiments described above are given by way of example only and various modifications will be apparent to persons skilled in the art without departing from the scope of the invention. For example, a single davit arm could be used in place of the davit arm arrangement 20; the housing, in which the lifeboat 12 is housed and the davit arm arrangement is disposed, could be located at the side of the vessel 10 on an external boat deck, in this case, conversion of at least part of the external boat deck to an internal boat deck should he considered; and the maintenance hatch 28 could be utilised as the hatch access for passengers to the lifeboat 12.

What is claimed is:

1. A vessel comprising a lifeboat, a housing positioned at the side of the vessel and defining a recess in which the lifeboat is stowed, hatch access to the lifeboat from a boat deck of the vessel, and means for deploying the lifeboat from its stowed position, the deployment means including at least one pivotable davit arm.

2. A vessel as claimed in claim 1, wherein the housing is formed in the hull of the vessel.

3. A vessel as claimed in claim 1, wherein the boat deck is an internal boat deck.

4. A vessel as claimed in claim 1, wherein a part of the recess and an adjacent side of the lifeboat are of complementary or substantially complementary shape.

5. A vessel as claimed in claim 1, wherein the recess comprises a notch in a surface thereof in which the keel of the lifeboat is received when stowed.

6. A vessel as claimed in claim 1, wherein the hatch access comprises a watertight hatch in the boat deck and an access hatch in the lifeboat, the watertight hatch and the access hatch being aligned when the lifeboat is stowed in the recess.

7. A vessel as claimed in claim 6, wherein, when the lifeboat is stowed, the watertight hatch and the access hatch are releasably mated.

8. A vessel as claimed in claim 6, wherein the hatch access further comprises a maintenance hatch which provides access to the housing and/or the lifeboat independently of the watertight hatch.

9. A vessel as claimed in claim 1, further comprising a latch mechanism by which the lifeboat is releasably held in the recess.

10. A vessel as claimed in claim 9, wherein the latch mechanism is operable from the vessel and the lifeboat.

11. A vessel as claimed in claim 1, wherein the at least one davit arm is pivotably supported by the vessel and releasably attached to the lifeboat by at least one fall wire.

12. A vessel as claimed in claim 11, wherein the deployment means is operable from the vessel.

13. A vessel as claimed in claim 11, wherein the deployment means is operable from the vessel and the lifeboat.

14. A vessel as claimed in claim 12, wherein, when the lifeboat is stowed, the centre of gravity of the lifeboat is to the inboard side of the davit arm.

15. A vessel as claimed in claim 13, wherein, when the lifeboat is stowed, the centre of gravity of the lifeboat is to the outboard side of the davit arm.

16. A vessel as claimed in claim 1, wherein operation of the deployment means can be gravity assisted.

17. A vessel comprising a lifeboat, a housing positioned at the side of the vessel and defining a recess in which the lifeboat is stowed, hatch access to the lifeboat from a boat deck of the vessel, and means for deploying the lifeboat from its stowed position, the hatch access including a watertight hatch in the boat deck, an access hatch in the lifeboat, and a maintenance hatch, the watertight hatch and the access hatch being aligned when the lifeboat is stowed in the recess, and the maintenance hatch providing access to the housing and/or the lifeboat independently of the watertight hatch.

* * * * *